US007731810B2

(12) United States Patent
Subramanian et al.

(10) Patent No.: US 7,731,810 B2
(45) Date of Patent: Jun. 8, 2010

(54) NANO PARTICLE-REINFORCED MO ALLOYS FOR X-RAY TARGETS AND METHOD TO MAKE

(75) Inventors: Pazhayannur Ramanathan Subramanian, Niskayuna, NY (US); Judson Sloan Marte, Wynantskill, NY (US); Paul Leonard Dupree, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 323 days.

(21) Appl. No.: 11/769,939

(22) Filed: Jun. 28, 2007

(65) Prior Publication Data

US 2008/0181805 A1 Jul. 31, 2008

Related U.S. Application Data

(62) Division of application No. 10/743,236, filed on Dec. 22, 2003, now Pat. No. 7,255,757.

(51) Int. Cl.
*C22F 1/18* (2006.01)

(52) U.S. Cl. ..... 148/513; 148/577; 148/668

(58) Field of Classification Search ..... None
See application file for complete search history.

(56) References Cited

U.S. PATENT DOCUMENTS

| | | | | |
|---|---|---|---|---|
| 5,006,163 | A | 4/1991 | Benn et al. | |
| 5,049,355 | A | 9/1991 | Gennari et al. | |
| 5,462,903 | A | 10/1995 | Rousset et al. | |
| 5,595,616 | A * | 1/1997 | Berczik | 148/538 |
| 6,074,497 | A * | 6/2000 | Inoue et al. | 148/403 |
| 6,939,388 | B2 * | 9/2005 | Angeliu | 75/332 |
| 7,255,757 | B2 * | 8/2007 | Subramanian et al. | 148/423 |
| 7,442,225 | B2 * | 10/2008 | Takada et al. | 75/245 |
| 2003/0035955 | A1 | 2/2003 | Yadav | |
| 2006/0048866 | A1 * | 3/2006 | Takada et al. | 148/423 |

FOREIGN PATENT DOCUMENTS

| | | | |
|---|---|---|---|
| EP | 0854765 | B1 | 4/2001 |
| WO | WO9707917 | A1 | 3/1997 |
| WO | WO0168936 | A1 | 9/2001 |
| WO | WO03031323 | A1 | 4/2003 |

* cited by examiner

*Primary Examiner*—George Wyszomierski
(74) *Attorney, Agent, or Firm*—Paul J. DiConza

(57) ABSTRACT

A nanocomposite comprising a plurality of nanoparticles dispersed in a molybdenum-based matrix, and an x-ray tube component formed from such a nanocomposite. The nanocomposite contains volume fraction of nanoparticle dispersoids in a range from about 2 volume percent to about 20 volume percent. A method of making such molybdenum-based nanocomposites is also disclosed.

15 Claims, 2 Drawing Sheets

NANO PARTICLE-REINFORCED MO ALLOYS FOR X-RAY TARGETS AND METHOD TO MAKE

This application is a divisional application of application Ser. No. 10/743,236, filed 22 Dec. 2003, now U.S. Pat. No. 7,255,757, which is hereby incorporated by reference in its entirety.

BACKGROUND OF INVENTION

The invention relates to a molybdenum-based nanocomposite. More particularly, the invention relates to an x-ray tube having an x-ray target comprising a molybdenum-based nanocomposite. Even more particularly, the invention provides a method for making molybdenum-based nanocomposites for x-ray applications.

X-ray tubes generate x-rays by bombarding a layer of an x-ray target material with high energy electrons. The target comprises elements with high atomic number (such as tungsten and rhenium) and is attached to a substrate disk comprising a refractory metallic material having a high thermal conductivity. To dissipate the intense heat generated by the electron bombardment, the target disk is rotated at speeds in excess of 8400 rpm. Additionally, the high-conductivity target disk conducts the heat to a graphite block, which acts as thermal storage material. In medical diagnostics, the demand for ever-improving x-ray image quality in conjunction with the need for computer tomography (CT) systems to perform high-speed cardiac imaging necessitates the use of high peak power (in excess of 70 kW), and high target rotation speeds, which increase the thermal and structural loading requirements of the target material well beyond current capabilities. Thus, there is a need for target materials with high strength and creep resistance to meet the thermal and structural demands generated by the use of high peak power and high rotation speeds.

The continuing effort to design and build more powerful and more efficient x-ray tube components requires the use of materials having enhanced high temperature performance capabilities. Such performance enhancements require state-of-the-art materials with vastly improved mechanical properties such as strength, creep resistance, and thermal stability.

For x-ray tube and other applications, high temperature structural materials can be strengthened in a number of ways such as, for example, grain refinement, solid solution strengthening, precipitate strengthening, composite strengthening, and dispersoid strengthening. One method of strengthening alloys known as Orowan strengthening incorporates a fine distribution of hard particles into a metallic alloy matrix. Orowan strengthening depends upon the formation of an array of dispersoid particles that serve as obstacles for impeding dislocation motion within the alloy matrix. The strength of these particle-reinforced alloys is inversely proportional to the spacing between these particles, which can be controlled in turn by controlling the size of the dispersoid particles. Thus, the use of nanoparticles as dispersoids offers the potential of substantially enhancing alloy strength.

The introduction of hard dispersoid nanoparticles during the processing of the nanodispersoid-reinforced alloys presents a technical challenge. Current processes to disperse particles include powder metallurgy routes, such as mechanical alloying of micron-sized particles, in combination with secondary processes, which include hot-isostatic pressing and thermomechanical processing by hot-forging or extrusion. In the mechanical alloying process, nanoparticles are created by repeated fracture of the micron-size dispersoid particles during milling. While this is a well-established process for oxide-dispersion strengthened (ODS) alloys in iron- and nickel-based alloys (such as, for example, Inconel MA alloys), the process fails to produce a homogeneous distribution of the particles in the molybdenum-based matrix, especially for large components. In addition, the loading of the particles in the alloy composites produced by this process is typically limited to less than 2 percent by volume.

Current processes are unable to produce alloy nanocomposites having sufficiently high loadings of nanoparticles. Therefore, what is needed is a molybdenum-based nanocomposite in which dispersoid nanoparticles are homogeneously distributed throughout the molybdenum-based matrix. What is also needed is a molybdenum-based nanocomposite having a sufficiently high loading of dispersoid nanoparticles having high temperature performance capabilities that are adequate for use in x-ray target assemblies. What is further needed is a method of making molybdenum-based nanocomposites having high loadings of dispersoid nanoparticles, wherein the dipersoid nanoparticles are homogeneously distributed throughout the alloy nanocomposite.

BRIEF SUMMARY OF INVENTION

The present invention meets these and other needs by providing a nanocomposite comprising a plurality of nanoparticles dispersed in a molybdenum-based metallic matrix, and an article formed from such a nanocomposite. The nanocomposite contains a higher volume fraction of nanoparticle dispersoids than those presently available. The nanocomposite may be used to fabricate articles, such as those used in making portions of x-ray targets. The present invention also discloses a method of making such nanocomposites.

Accordingly, one aspect of the invention is to provide an x-ray tube comprising an x-ray target substrate, wherein the x-ray target substrate comprises a molybdenum-based nanocomposite. The molybdenum-based nanocomposite comprises: a metallic matrix comprising molybdenum; and a plurality of nanoparticles dispersed throughout the metallic matrix. The plurality of nanoparticles comprises from about 2 volume percent to about 20 volume percent of the molybdenum-based nanocomposite.

A second aspect of the invention is to provide a nanocomposite. The nanocomposite comprises: a molybdenum-based metallic matrix; and a plurality of nanoparticles dispersed throughout the molybdenum-based metallic matrix. The plurality of nanoparticles comprises from about 2 volume percent to about 20 volume percent of the nanocomposite.

A third aspect of the invention is to provide an article comprising a nanocomposite. The nanocomposite comprises: a molybdenum-based metallic matrix, wherein the molybdenum-based metallic matrix comprises at least one of elemental molybdenum and a molybdenum-based alloy, and combinations thereof; and a plurality of nanoparticles dispersed throughout the molybdenum-based metallic matrix, wherein the plurality of nanoparticles comprises from about 2 volume percent to about 20 volume percent of the nanocomposite, and wherein the nanocomposite is formed by providing a nanocomposite powder by one of mechanical milling and cryogenic milling, consolidating the nanocomposite powder to make a green body, thermomechanically processing the green body to form the nanocomposite.

A fourth aspect of the invention is to provide a method of making a bulk nanocomposite. The bulk nanocomposite comprises a molybdenum-based metallic matrix and a plurality of nanoparticles dispersed throughout the molybdenum-based metallic matrix, and wherein the plurality of the nanoparticles comprises from about 2 volume percent to about 20 volume percent of the bulk nanocomposite. The method comprises: providing a nanocomposite powder, wherein the nanocomposite powder comprises a plurality of nanoparticles and a molybdenum-based metallic matrix material; consolidating the nanocomposite powder; and thermomechanically processing the nanocomposite powder to form the bulk nanocomposite.

A fifth aspect of the invention is to provide a method of making a portion of an x-ray target. The method comprises: providing a nanocomposite, wherein the nanocomposite comprises a molybdenum-based metallic matrix and a plurality of nanoparticles dispersed throughout the molybdenum-based metallic matrix, and wherein the plurality of the nanoparticles comprises from about 2 volume percent to about 20 volume percent of the nanocomposite, wherein the nanocomposite is formed by providing a nanocomposite powder, wherein the nanocomposite powder comprises a plurality of nanoparticles and a molybdenum-based metallic matrix material; consolidating the nanocomposite powder; and thermomechanically processing the nanocomposite powder to form the nanocomposite; and shaping the nanocomposite into a nanocomposite substrate.

These and other aspects, advantages, and salient features of the present invention will become apparent from the following detailed description, the accompanying drawings, and the appended claims.

DETAILED DESCRIPTION

Figure 1:
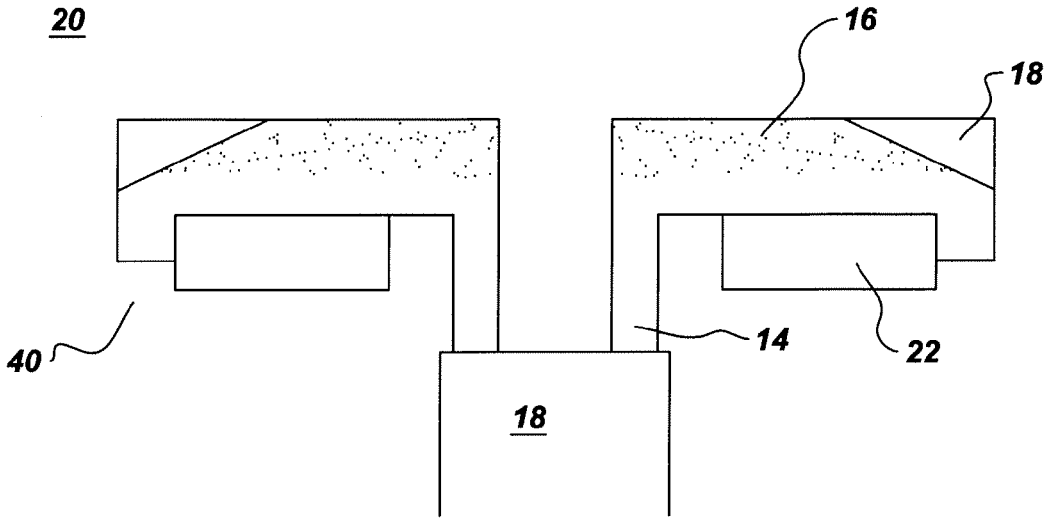
FIG. 1 is a schematic representation of a cross-section of an x-ray target comprising a nanocomposite of the present invention.

In the following description, like reference characters designate like or corresponding parts throughout the several views shown in the figures. It is also understood that terms such as "top," "bottom," "outward," "inward," and the like are words of convenience and are not to be construed as limiting terms.

The present invention provides a method for making nanodispersoid-reinforced molybdenum-based nanocomposites. In addition, an x-ray tube having an x-ray target substrate comprising such molybdenum-based nanocomposites. Molybdenum-based nanocomposite powders are produced by blending molybdenum and molybdenum alloy powders with nanodispersoid hard particles such as oxides, carbides, or nitrides, wherein the nanodispersoid hard particles have sizes ranging from about 10 nm to about 500 nm, using techniques such as mechanofusion and mechanical alloying. The nanocomposite powders are thermo-mechanically processed using forging or hot-rolling or hot-extrusion to make a bulk nano dispersoid-reinforced molybdenum nanocomposite. The molybdenum-based nanocomposite yields an x-ray target substrate material with significantly higher strength and creep compared to commonly used x-ray target substrate materials, such as TZM.

Referring to the drawings in general and to FIG. 1 in particular, it will be understood that the illustrations are for the purpose of describing a preferred embodiment of the invention and are not intended to limit the invention thereto. Turning to FIG. 1, a schematic representation of a cross-section of an x-ray tube 20 comprising a rotating x-ray target assembly 40 that includes a molybdenum-based nanocomposite of the present invention is shown. Target assembly 40 comprises a target 18 (also referred to hereinafter as a "focal track") that emits x-rays when bombarded with high energy electrons, which are generated by a cathode (not shown) and impinge on target 18. Target 18 is typically made of tungsten, rhenium, or a tungsten-rhenium alloy. Target 18 is formed on an upper surface of a target substrate 16, which comprises the molybdenum-based nanocomposite of the present invention. Target substrate 16 is backed by a graphite ring 22, which is brazed to the target substrate and forms part of the target assembly 12. Graphite ring 22 acts as thermal storage material. A stem 14, which is integrally formed with target substrate 16, couples target assembly 40 through cylindrical rotor 18 to an induction motor (not shown) that rotates target assembly 40. Among the x-ray tubes that fall within the scope of the present invention are x-ray tubes used in medical diagnostics, imaging and in materials characterization. However, it will be appreciated by those skilled in the art that other x-ray tubes will fall within the scope of the invention.

Figure 2:
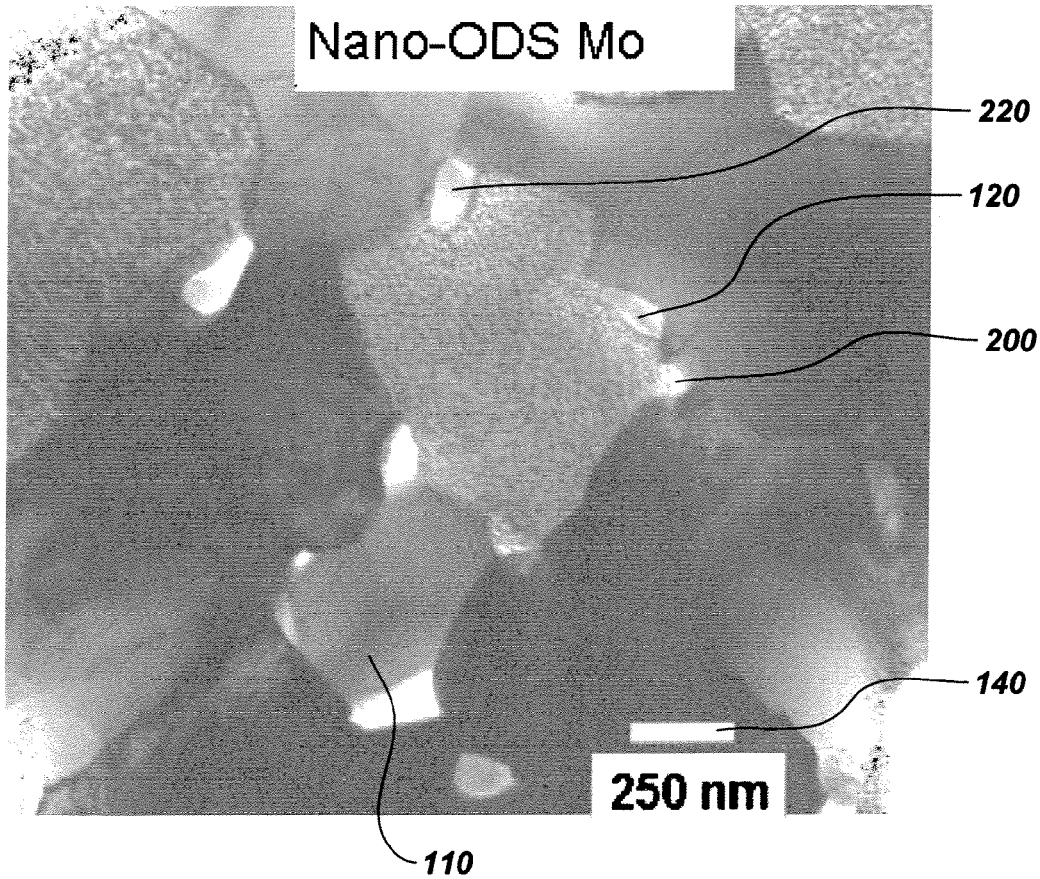
FIG. 2 is a scanning electron microscopy (SEM) image of a molybdenum-based nanocomposite of the present invention containing yttrium oxide.

FIG. 2 is a back scattered SEM image of a molybdenum-based nanocomposite 90 of the present invention. Molybdenum-based nanocomposite 90 comprises a metallic matrix 100. Metal matrix 100 comprises molybdenum. A plurality of nanoparticles 120 is dispersed throughout metallic matrix 100. The plurality of nanoparticles 120 comprises from about 2 volume percent to about 20 volume percent of molybdenum-based nanocomposite 90.

In one embodiment of the present invention, metallic matrix 100 comprises at least one of elemental molybdenum, a molybdenum-based alloy, and combinations thereof. In another embodiment, each of the plurality of nanoparticles 120 comprises at least one of an inorganic oxide, an inorganic carbide, an inorganic nitride, an inorganic boride, an inorganic oxycarbide, an inorganic oxynitride, an inorganic silicide, an inorganic aluminide, and combinations thereof. Inorganic oxides that may comprise the plurality of nanoparticles 120 include, but are not limited to, rare earth oxides, yttria, alumina, zirconia, hafnia, titania, calcia, magnesia, and combinations thereof. In a preferred embodiment, the inorganic oxide is yttria. Inorganic carbides that may comprise the plurality of nanoparticles 120 include, but are not limited to, carbides of at least one of hafnium, tantalum, molybdenum, zirconium, niobium, chromium, titanium, tungsten, and combinations thereof.

Molybdenum-based nanocomposite 90 comprises a metallic matrix 100 that comprises matrix grains 110; and a plurality of nanoparticles 120 dispersed throughout the metallic matrix 100. The plurality of nanoparticles 120 comprises from about 2 volume percent to about 10 volume percent of nanocomposite 90. In particular, FIG. 2 shows a molybdenum-based nanocomposite 90 in which metallic matrix 100 comprises molybdenum and the plurality of nanoparticles 120 comprises yttrium oxide ($Y_2O_3$). Each of the plurality of nanoparticles 120 has at least one dimension 140 that is in a range from about 10 nm to about 500 nm. In one embodiment, at least one dimension 140 of each one of the plurality of nanoparticles 120 is in a range from about 10 nm to about 30 nm. In one embodiment, each of the plurality of nanoparticles 120 is substantially spherical 200 in shape. In another embodiment of the invention, each of the plurality of nanoparticles may be ellipsoidal 220. Alternatively, the plurality of nanoparticles 120 may comprise a mixture of nanoparticles having a variety of such shapes. Each of the plurality of nanoparticles 120 may also take the form of needles, rod, cubes, and the like.

One method of strengthening of alloys is a mechanism known as Orowan strengthening, in which a fine distribution incorporation of hard particles is incorporated into an alloy. In this strengthening mechanism, an array of dispersoid particles impedes dislocation motion. The strength of such particle-reinforced alloys is inversely proportional to the spacing between the dispersoid particles. Spacing of the dispersoid particles can, in turn, can be controlled by controlling the size of the dispersoid particles. For a given volume of dispersoid particles, using dispersoid particles with sizes in the nanometer range can decrease spacing and thus substantially enhance alloy strength.

Processes that are currently used to disperse particles include powder metallurgy routes such as, but not limited to, blending of powders, followed by hot-pressing or hot isostatic pressing to densify the blended powder mixture, and sintering in combination with secondary processes, such as mechanical alloying processes and the like. In the mechanical alloying process, nanoparticles are created by repeated fracture of micron-size dispersoid particles during milling. Such processes fail to achieve a homogeneous particles distribution within the alloy, particularly for large components. In addition, the loading of the particles in the alloys formed by such processes is typically limited to less than 2 percent by volume.

Figure 3:
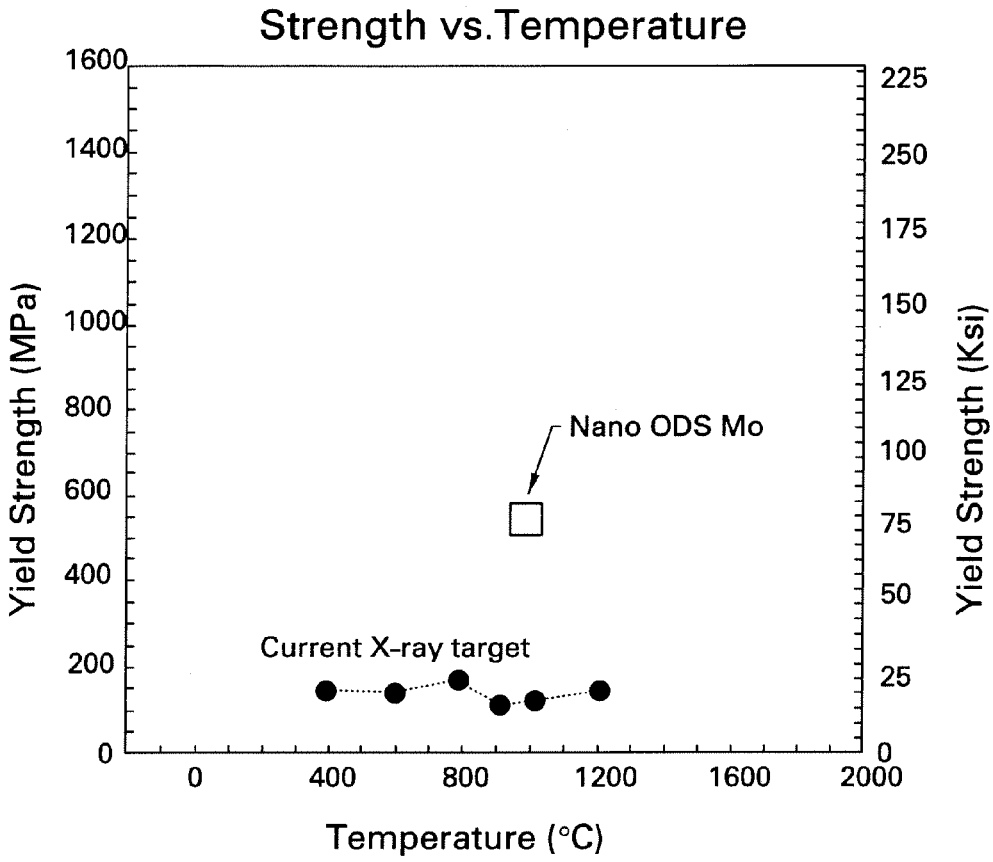
FIG. 3 is a plot of yield strength versus temperature for current x-ray target substrate materials and a molybdenum-based nanocomposite of the present invention containing yttrium oxide.

Accordingly, molybdenum-based nanocomposite 90 provided by the present invention overcomes the loading and dispersion limitations encountered with current dispersoid strengthened alloys. FIG. 3 is a plot of yield strength versus temperature for current x-ray target substrate materials and a molybdenum-based nanocomposite 90 of the present invention. As shown in FIG. 3, the invention provides a molybdenum-based nanocomposite 90 with superior mechanical properties achieved through dispersoid strengthening by a providing a higher volume fraction of nanoparticle dispersoids than presently achievable loadings. The plurality of nanoparticles 120 comprises from about 2 volume percent to about 10 volume percent of molybdenum-based nanocomposite 90.

The higher volume loadings of the plurality of nanoparticles 120 of the present invention provide molybdenum-based nanocomposite 90 with mechanical properties that are superior to those of current state-of-the art materials. Molybdenum-based nanocomposite 90 also exhibits greater microstructural stability at elevated temperatures, allowing yield strength and creep resistance to be retained at much higher temperatures than those provided by current oxide dispersion strengthened (ODS) alloys. Molybdenum-based nanocomposite 90 is thermally stable up to about 1200° C., and has a strength in a range from about 400 MPa to about 1200 MPa Molybdenum-based nanocomposite 90 demonstrates a manifold increase in yield strength and in high temperature stability over prior art.

In addition to molybdenum-based nanocomposite 90 and an x-ray tube comprising molybdenum-based nanocomposite 90, the present invention also provides a method of making molybdenum-based nanocomposite 90. A flow chart illustrating a method 300 of making molybdenum-based nanocomposite 90 is shown in FIG. 4.

Figure 4:
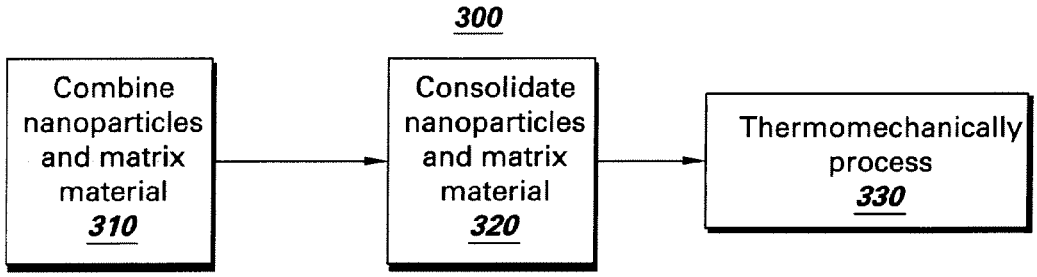
FIG. 4 is a flow chart illustrating the method of making nanocomposite of the present invention.

Referring to Step 310 in FIG. 4, a plurality of nanoparticles 120 is first combined with a molybdenum-based metallic matrix material, such as, for example, an alloy powder, to form a nanocomposite powder. In one embodiment, the nanocomposite powder is produced by blending at least one molybdenum-based metallic alloy powder with a predetermined volume fraction of hard dispersoid nanoparticles having at least one dimension ranging from about 10 nm to about 500 nm. The dispersoid particles comprise from about 2 volume percent to about 20 volume percent of a bulk nanocomposite. Techniques, such as, mechanofusion, mechanical alloying, cryomilling, and the like, are used separately or in combination with each other to form the nanocomposite powder.

In one embodiment, the nanocomposite powder is produced by in-situ formation of dispersoid nanoparticles 120 within an alloyed molybdenum-based metallic matrix 100. This is achieved by cryomilling micron-sized particles of the metallic alloy matrix material in a reactive atmosphere, comprising, for example, at least one of nitrogen, and a hydrocarbon. The gases present in the reactive atmosphere may additionally serve as the coolant for cryomilling. Alternatively, cryomilling may be performed in an inert atmosphere that comprises, for example, at least one of argon and helium.

The cryomilling feedstock comprises at least one molybdenum-based metal powder. The molybdenum-based metal powder comprises at least one of elemental molybdenum, a molybdenum-based alloy, and combinations thereof. In one embodiment, the molybdenum-based alloy comprises at least one metallic element that is either reactive or refractory in nature. Such metallic elements include, but are not limited to, Al, Cr, Ti, Nb, Ta, W, B, Zr, Hf, combinations thereof, and the like. These elements can either comprise the molybdenum-based alloy powder or they can be added as separate elements, which then can form the dispersoid nanoparticles by combining with the reactive gases during cryomilling. Nanoparticles 120 comprising the metallic elements are formed by cryomilling such molybdenum-based alloys. The cryomilling action separates highly reactive nanosize particles from the micron-size particles of molybdenum-based matrix material. When cryomilled in a reactive atmosphere, the molybdenum nanoparticles react with the reactive gases to form hard dipersoid nanoparticles, such as oxides, carbide, nitrides, combinations thereof, and the like. The hard dispersoid nanoparticles surround each of the micron-size particles of metallic alloy matrix material to achieve the fine distribution incorporation that is needed for Orowan strengthening.

The nanocomposite powder is then consolidated (Step 320) and thermo-mechanically processed (Step 330) to form a bulk dispersoid nanoparticle-reinforced molybdenum-based nanocomposite 90. Consolidation of the nanocomposite powder (Step 320) into a compact is performed using techniques that are known in the metallurgical arts, such as cold pressing, hot pressing, hot isostatic pressing, and the like. Step 330 is carried out using techniques such as, but not limited to, forging, hot-extrusion, and hot-rolling, either separately or in combination with each other. In another embodiment, dispersoid nanoparticle-reinforced molybdenum-based nanocomposite 90 is formed from the consolidated nanocomposite powder compact by subjecting the nanocomposite powder compact to severe plastic deformation. Such severe plastic deformation may be accomplished by one of equiaxial channel angular processing, torsion extrusion, and twist extrusion of the nanocomposite powder.

The following example illustrates the advantages and features of the invention, and is not intended to limit the invention in any way.

Molybdenum-based nanocomposites have been fabricated using the following steps. Molybdenum (−325 mesh (44 micron)) powder was first blended with 50-100 nm size yttrium oxide nanoparticles using mechanofusion wherein the yttrium oxide nanoparticles are mechanically fused or embedded into the Mo powder surface to obtain nanocomposite powders. The volume fraction of the yttrium oxide nanoparticles ranged from 2 to 10 volume percent. The nanocomposite powder was then enclosed in a stainless steel can, which was then evacuated and sealed. Alternatively, materials with higher strength and temperature capability, such as molybdenum, can be used as canning material so as to enable extrusion at higher temperatures. The as-fabricated nanocomposite powder was next consolidated by extruding the can against a flat faced die at a temperature of 1300° C. The can was then re-machined in preparation for a through-die extrusion. The re-machined can was then hot-extruded at a temperature of 1300° C. using a 9:1 reduction ratio. The as-fabricated molybdenum-based nanocomposite was examined by scanning electron microscopy to evaluate the matrix grain size and the dispersoid size as well as distribution in the Mo matrix. FIG. 2 is an SEM image of the molybdenum-based nanocomposite, showing yttrium oxide nanoparticles 120, 200, 220 uniformly distributed at the grain boundaries of the molybdenum matrix material. The yttrium oxide nanoparticles exhibit different morphologies, including substantially spherical shapes 200 and substantially ellipsoidal shapes 220. Tensile tests were performed to validate the capability of the molybdenum-based nanocomposite as a target material. A plot of yield strength versus temperature for current x-ray target substrate materials and a molybdenum-based nanocomposite is shown in FIG. 3. The molybdenum-based nanocomposite (labeled "nano ODS Mo" in FIG. 3) exhibits a yield strength that is approximately triple that of current x-ray target materials.

While typical embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

The invention claimed is:

1. A method of making a bulk nanocomposite, wherein said bulk nanocomposite comprises a molybdenum-based metallic matrix and a plurality of nanoparticles dispersed throughout said molybdenum-based metallic matrix, and wherein the plurality of said nanoparticles comprises from about 2 volume percent to about 20 volume percent of said bulk nanocomposite, said method comprising the steps of:

a) providing a nanocomposite powder, wherein said nanocomposite powder comprises a plurality of nanoparticles and a molybdenum-based metallic matrix material, wherein providing a nanocomposite powder comprises cryomilling said molybdenum-based metallic matrix material to form said plurality of nanoparticles;

b) consolidating said nanocomposite powder; and c) thermomechanically processing said nanocomposite powder to form said bulk nanocomposite.

2. The method according to claim 1, wherein said cryomilling said molybdenum-based metallic matrix material comprises cryomilling said molybdenum-based metallic matrix material in a reactive atmosphere.

3. The method according to claim 2, wherein said reactive atmosphere comprises at least one of nitrogen and a hydrocarbon.

4. A method of making portion of an x-ray target, said method comprising the steps of:

a) providing a nanocomposite, wherein said nanocomposite comprises a molybdenum-based metallic matrix and a plurality of nanoparticles dispersed throughout said molybdenum-based metallic matrix, and wherein the plurality of said nanoparticles comprises from about 2 volume percent to about 20 volume percent of said nanocomposite, wherein said nanocomposite is formed by providing a nanocomposite powder, wherein said nanocomposite powder comprises a plurality of nanoparticles and a molybdenum-based metallic matrix material; consolidating said nanocomposite powder; and thermomechanically processing said nanocomposite powder to form said nanocomposite;

b) shaping said nanocomposite into a nanocomposite disk;

c) providing a substrate; and d) bonding said nanocomposite disk to said substrate.

5. The method according to claim 4, wherein said step of providing a nanocomposite comprises forming said plurality of nanoparticles by at least one of mechanofusion, mechanical alloying, cryomilling, and combinations thereof.

6. The method according to claim 4, wherein said thermomechanically processing the nanocomposite powder comprises cryomilling said molybdenum-based metallic matrix material to form said plurality of nanoparticles.

7. The method according to claim 6, wherein said cryomilling said molybdenum-based metallic matrix material comprises cryomilling said molybdenum-based metallic matrix material in a reactive atmosphere.

8. The method according to claim 7, wherein said reactive atmosphere comprises at least one of nitrogen and a hydrocarbon.

9. The method according to claim 4, wherein said consolidating said nanocomposite powder comprises pressing said nanocomposite powder to form a compact.

10. The method according to claim 4, wherein said thermomechanically processing said nanocomposite powder comprises at least one of forging, hot-extruding, and hot-rolling said nanocomposite powder.

11. The method according to claim 4, wherein said step of thermomechanically processing said nanocomposite powder comprises subjecting said nanocomposite powder compact to severe plastic deformation.

12. The method according to claim 11, wherein said severe plastic deformation comprises at least one of equiaxial channel angular processing of said nanocomposite powder, torsion extruding said nanocomposite powder, and twist extruding said nanocomposite powder.

13. The method according to claim 4, wherein said step of bonding said nanocomposite disk to said substrate comprises one of brazing said nanocomposite disk to said substrate, diffusion bonding said nanocomposite disk to said substrate, and roll bonding said nanocomposite disk to said substrate.

14. The method according to claim 4, wherein said step of providing a substrate comprises providing at least one of elemental molybdenum and a molybdenum-based alloy.

15. The method according to claim 4, wherein said step of providing a substrate comprises providing a molybdenum-based matrix material.

* * * * *

UNITED STATES PATENT AND TRADEMARK OFFICE

CERTIFICATE OF CORRECTION

PATENT NO. : 7,731,810 B2
APPLICATION NO. : 11/769939
DATED : June 8, 2010
INVENTOR(S) : Subramanian et al.

It is certified that error appears in the above-identified patent and that said Letters Patent is hereby corrected as shown below:

In Fig. 3, Sheet 2 of 2, along "Yield Strength (Ksi)", Line 2, delete "250" and insert -- 200 --, therefor.

In Column 8, Line 43, in Claim 11, after "powder" delete "compact".

Signed and Sealed this
Seventh Day of June, 2011

David J. Kappos

David J. Kappos
*Director of the United States Patent and Trademark Office*